US008684477B1

(12) United States Patent
Maresh

(10) Patent No.: US 8,684,477 B1
(45) Date of Patent: Apr. 1, 2014

(54) CABINET DOOR WITH RETRACTABLE PANEL

(76) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 13/396,588

(22) Filed: Feb. 14, 2012

Related U.S. Application Data

(60) Provisional application No. 61/463,204, filed on Feb. 14, 2011.

(51) Int. Cl.
*E06B 3/00* (2006.01)

(52) U.S. Cl.
USPC ..... 312/292; 49/501

(58) Field of Classification Search
USPC ..... 49/61, 62, 63, 163, 164, 501, 142, 143, 49/169, 170, 171, 323, 372–374; 312/292, 312/319.2, 326, 329
See application file for complete search history.

(56) References Cited

U.S. PATENT DOCUMENTS

| | | | | |
|---|---|---|---|---|
| 1,273,520 | A * | 7/1918 | Millsaps | 49/168 |
| 2,972,825 | A * | 2/1961 | Stillwell et al. | 49/410 |
| 4,702,536 | A * | 10/1987 | Kraynak | 312/330.1 |
| 2007/0234643 | A1* | 10/2007 | Siegal et al. | 49/360 |
| 2009/0151264 | A1* | 6/2009 | Boens | 49/383 |
| 2010/0101149 | A1* | 4/2010 | Keller | 49/399 |
| 2010/0242366 | A1* | 9/2010 | Liebscher et al. | 49/142 |
| 2011/0225886 | A1* | 9/2011 | Block et al. | 49/31 |

* cited by examiner

*Primary Examiner* — Katherine Mitchell
*Assistant Examiner* — Abe Massad
(74) *Attorney, Agent, or Firm* — Nick A Nichols, Jr.

(57) ABSTRACT

A cabinet door assembly is moveably mounted to a cabinet to selectively close a chamber. The cabinet door has a substantially planar first panel and a substantially planar second panel in a planar parallel configuration. The second panel may retract relative to the first panel upon application of an impact force to the second panel. A stop member may be incorporated to limit the downward movement of the second panel. Ramp surfaces and a guide member cooperate to facilitate upward and/or inward directional movement of the second panel relative to the first panel upon application of an impact force to the second panel.

14 Claims, 6 Drawing Sheets

CABINET DOOR WITH RETRACTABLE PANEL

CROSS-REFERENCE TO RELATED APPLICATION

This application claims the benefit of U.S. Provisional Application Ser. No. 61/463,204, filed Feb. 14, 2011, which application is incorporated herein by reference.

BACKGROUND OF THE INVENTION

The present invention relates to cabinet doors, and in particular to a safety feature integrated within a cabinet door for mitigating injuries due to head and/or body impact with a cabinet door.

Serious injuries due to an impact with a cabinet door are well reported in the media, and typically are caused by a collision with a cabinet door and a person's head. In the most severe injuries, the cabinet door does not yield, or open or close during horizontal impact. In the instance of generally direct horizontal impact with the door edge, the impact force direction is directed toward the axis of rotation of the cabinet door, and thus the cabinet door will not rotate or move in reaction away from the impact force. In the instance of generally vertical impact, such as when a person may be bent over or crouched down, and hit his head against a cabinet door when rising, the impact force is generally parallel to the axis or rotation of the cabinet door, and thus the cabinet door will also not move in reaction away from the impact force. In both of these instances, the door does not yield or move, and the impact force is directly proportional to the impact velocity. This hazardous event may be described with regards to conservation of momentum, where the product of the mass of two colliding objects and their respective velocities is conserved, and wherein $m_1v_1=m_2v_2$, however in the instance of the prior art, the velocity of the cabinet door may be near zero with no cabinet door reactive rotation due to the impact angle, thus causing a significant number of injuries each year. In this respect, a cabinet door with a retractable panel may provide a safety solution to such prior art cabinet door hazards, as in instances when vertically or horizontally directed impact occurs, and wherein a portion of the cabinet door will readily move or collapse away from the impact site, thus greatly reducing the possibility of potential injury

SUMMARY OF THE INVENTION

A cabinet door assembly is moveably mounted to a cabinet to selectively close a chamber. The cabinet door has a substantially planar first panel and a substantially planar second panel in planar parallel configuration. The second panel may retract relative to the first panel upon application of an impact force to the second panel. A stop member may be incorporated to limit the downward movement of the second panel. Oppositely facing ramp surfaces and a guide member cooperate to facilitate upward and/or inward directional movement of the second panel relative to the first panel upon application of an impact force to the second panel.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
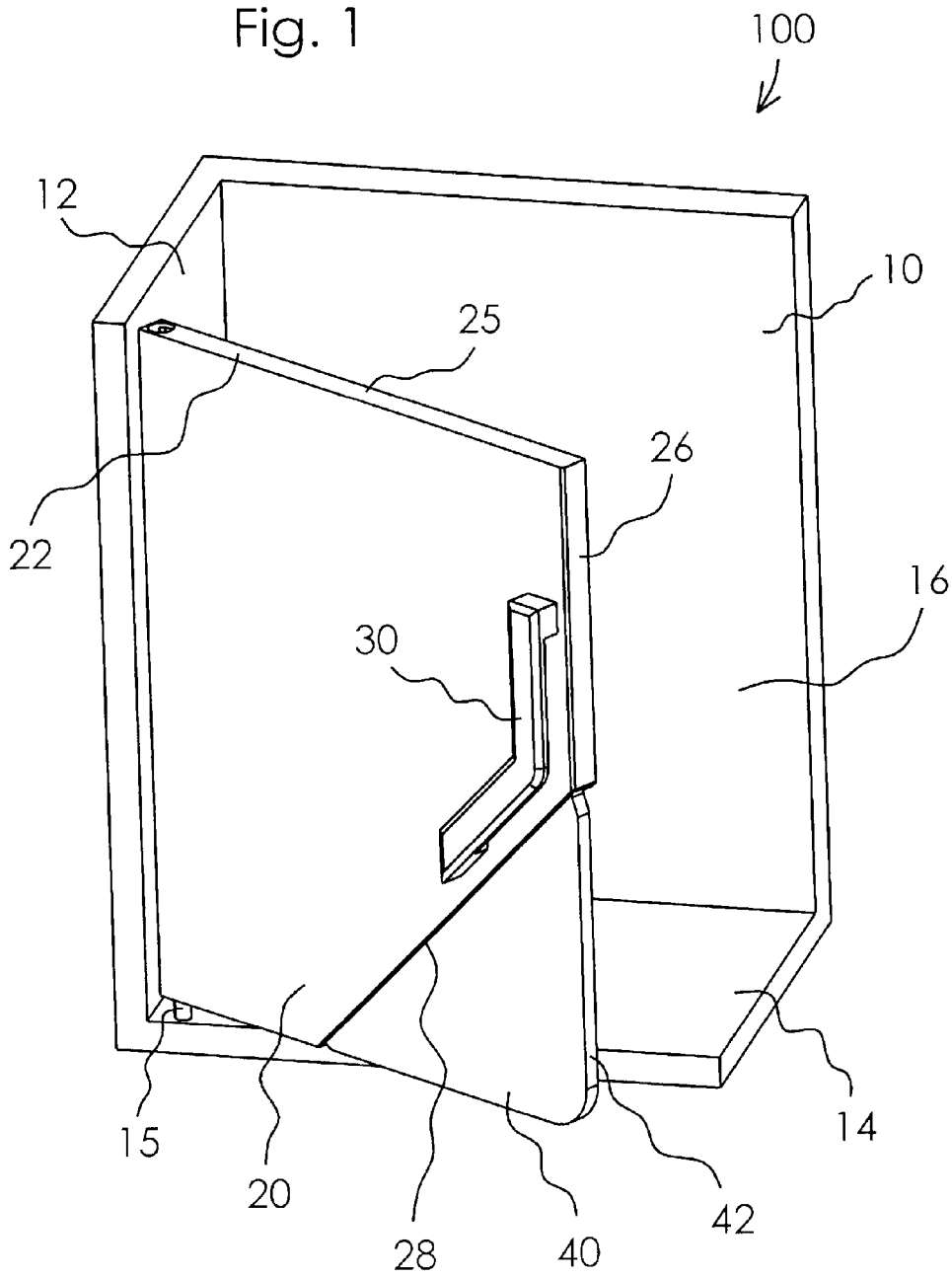
FIG. 1 is a partially broken away front perspective view of a first embodiment of a cabinet door with a retractable panel in a closed position.

Referring first to FIG. 1, a first embodiment of a cabinet, such as a kitchen cabinet, is generally identified by the reference numeral 100. The cabinet 100 is typically rigidly secured to a wall or the like at an elevated position to facilitate convenient access to the interior of the cabinet 100. The cabinet 100 comprises a back wall 10, sidewalls 12, a bottom 14 and a top wall or cover configured and rigidly secured together to define an interior chamber 16. For purposes of convenience in showing the interior structural components of the cabinet 100, the top wall and one of the sidewalls 12 are not shown in the drawings.

A door 20 forms the front of the cabinet 100. The door 20 may be substantially planar and include an upstanding flange 22 extending partially about the perimeter of the door 20. The flange 22 projects outward from and is oriented substantially perpendicular to the back or interior surface of the door 20. The door 20 is rotatably secured at the top and bottom of the cabinet 100 at bearings 15. Other available cabinet door securing means, such as hinges or the like, may be utilized if desired.

The flange 22 includes a rear vertical segment 24, a top horizontal segment 25, a leading vertical segment 26 and a bottom horizontal segment 27. The lower forward or leading end 28 of the door 20 extends at an angle from the lower end of the leading vertical segment 26 to the forward end of the horizontal segment 27 of the flange 22. The flange 22 defines a substantially continuous perimeter about the door 20 with the exception of a gap along the leading end 28 of the door 20.

A door handle 30 may be rigidly secured to the door 20. Levers and/or buttons or the like (not shown in the drawings) may be provided for latching the door 20 or other purposes. Switches for illumination or other electrical functions may also be provided for the cabinet 100.

Figure 2:
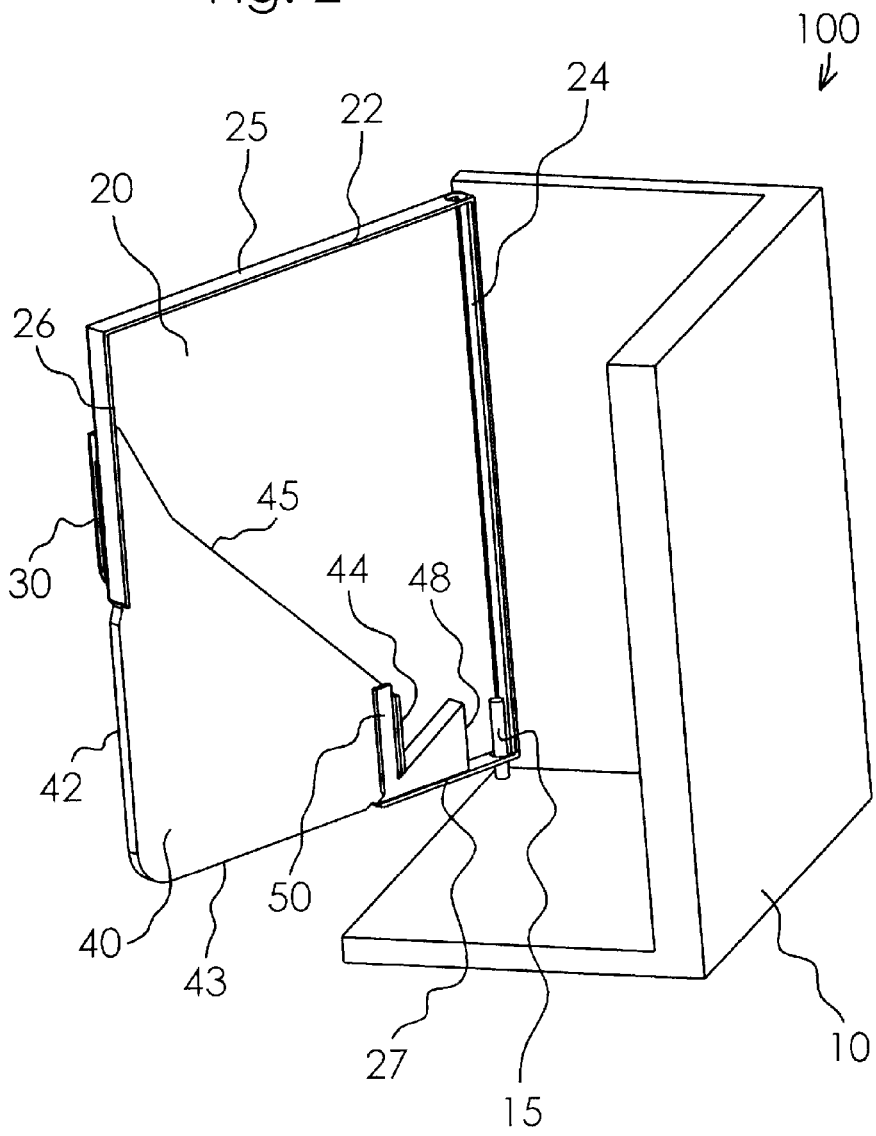
FIG. 2 is a partially broken away side perspective view of the embodiment of the cabinet door shown in FIG. 1.
Figure 3:
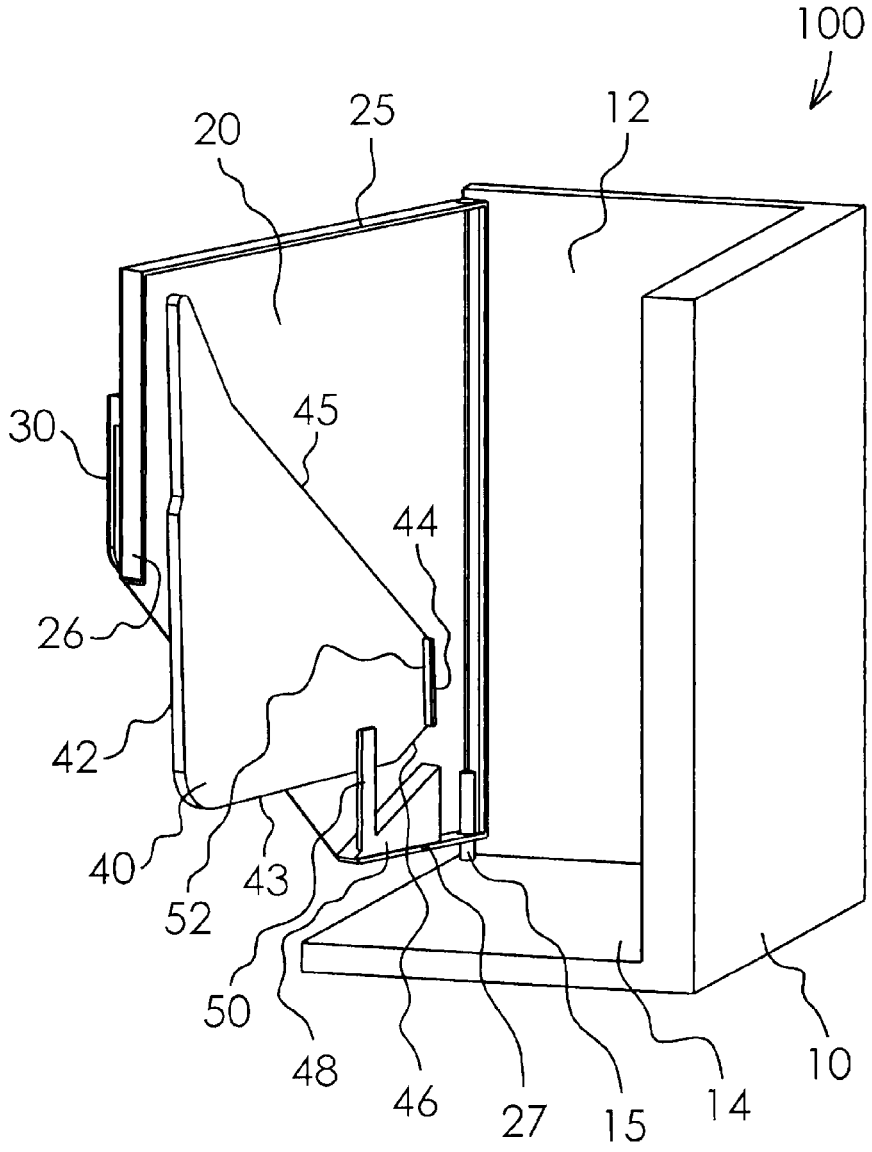
FIG. 3 is a partially broken away side perspective view of the embodiment of the cabinet door shown in FIG. 1 showing the retractable panel in a partially retracted position.
Figure 4:
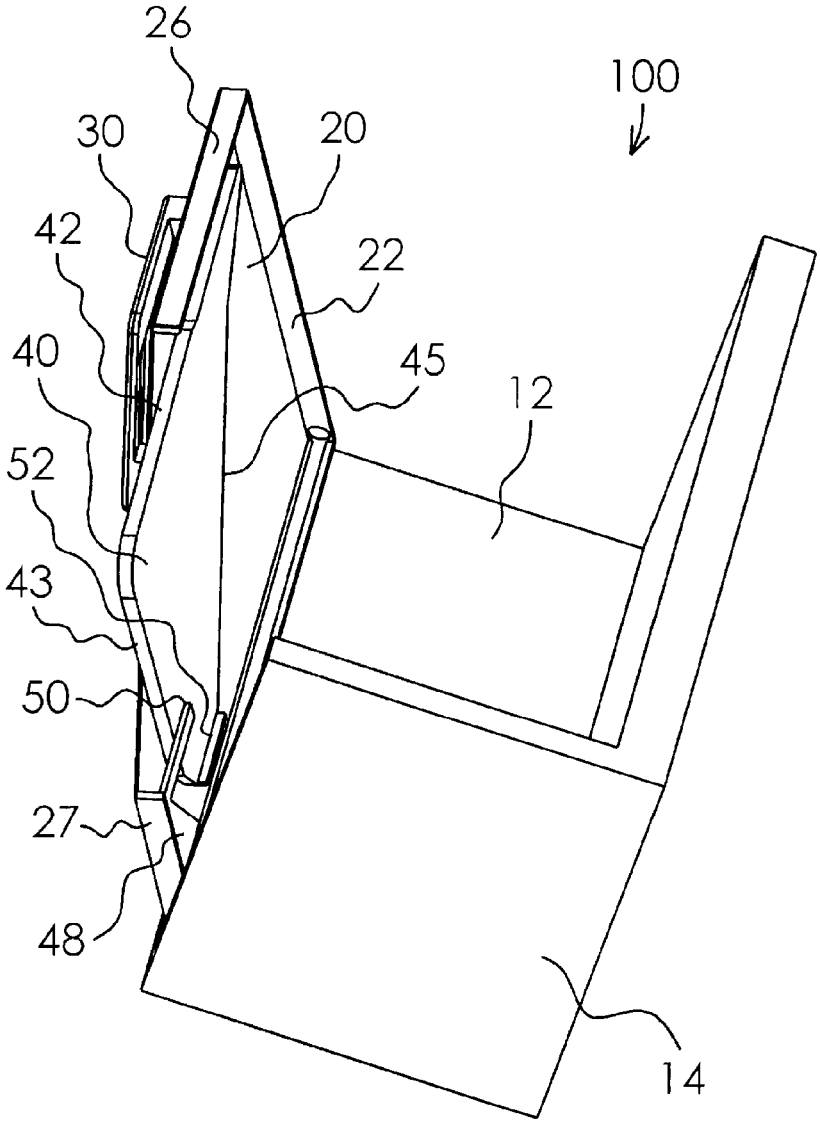
FIG. 4 is a partially broken away bottom perspective view of the embodiment of the cabinet door shown in FIG. 3.

Referring now to FIG. 2, a door panel 40 is generally constrained in a planar parallel manner with the door 20. The door panel 40 is preferably constructed of relatively light materials, for example, sheet metal, wood, glass, plastic or the like. The door panel 40 is moveably mounted on the back surface of the door 20. The door panel 40 may comprise a substantially planar body having a thickness approximately equal to the width of the flange 22 projecting from the back surface of the door 20. The door panel 40 includes a leading vertical edge 42, a horizontal bottom edge 43, a rear vertical edge 44 and an angularly extending edge 45 terminating at the upper end of the leading vertical edge 42 thereof.

The door panel 40 is free to move in an upward and rearward direction relative to the door 20 but constrained to move in a planar parallel manner with respect to the door 20. In the parked or closed position of the door panel 40, as best shown in FIG. 2, the horizontal bottom edge 43 of the door panel 40 is coplanar with the horizontal bottom segment 27 of the flange 22. The rearward end of the horizontal bottom edge 43 of the door panel 40 terminates in an inclined portion defining a ramp surface 46 in facing contact with a ramp 48 secured to the horizontal bottom segment 27 of the flange 22. The inclination angles of the ramp surface 46 and the ramp 48 may be in the range of 30 degrees to 60 degrees, more preferably 45 degrees.

Planar coincidence between the door 20 and the door panel 40 is maintained by a guide 50 fixedly secured and extending vertically upward from the bottom segment 27 of the flange 22. Alternatively, the door 20 may be provided with an interior planar panel secured to the flange 22 thus forming a cavity between front and interior panels of the door 20 for receipt of the door panel 40 therein and thereby maintain planar parallelism between the door 20 and the door panel 40.

A stop member 52 may be provided to limit the downward movement of the door panel 40. The stop 52 may be mounted on the door panel 40 along or proximate the rear vertical edge 44 thereof. Similarly, a stop to limit the upward movement of the door panel may also be provided. Gravity may be sufficient to maintain the door panel 40 in the closed position, however, low friction tape or the like may be employed if desired.

Figure 5:
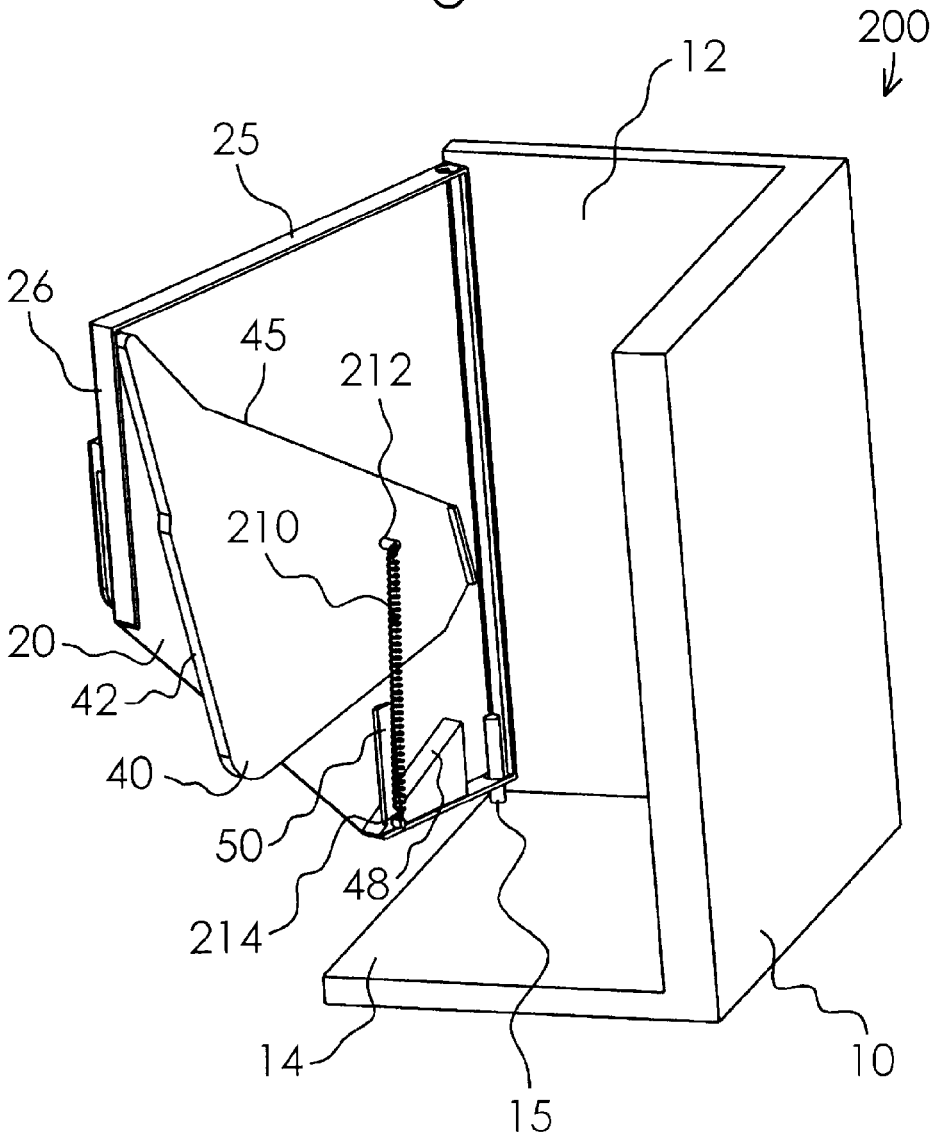
FIG. 5 is a partially broken away side perspective view of a second embodiment of a cabinet door with a retractable panel in a retracted position.

Referring now to FIG. 5, a second embodiment of a cabinet door with a retractable panel is generally identified by the reference numeral 200. The cabinet 200 is substantially similar to the cabinet 100 described above with the exception that the cabinet 200 includes an extension spring 210 having one end 212 secured to the door panel 40 and an opposite end 214 secured to the ramp 48. The spring 210 is maintained in tension for returning the door panel 40 to the closed position after receipt of an impact force.

Figure 6:
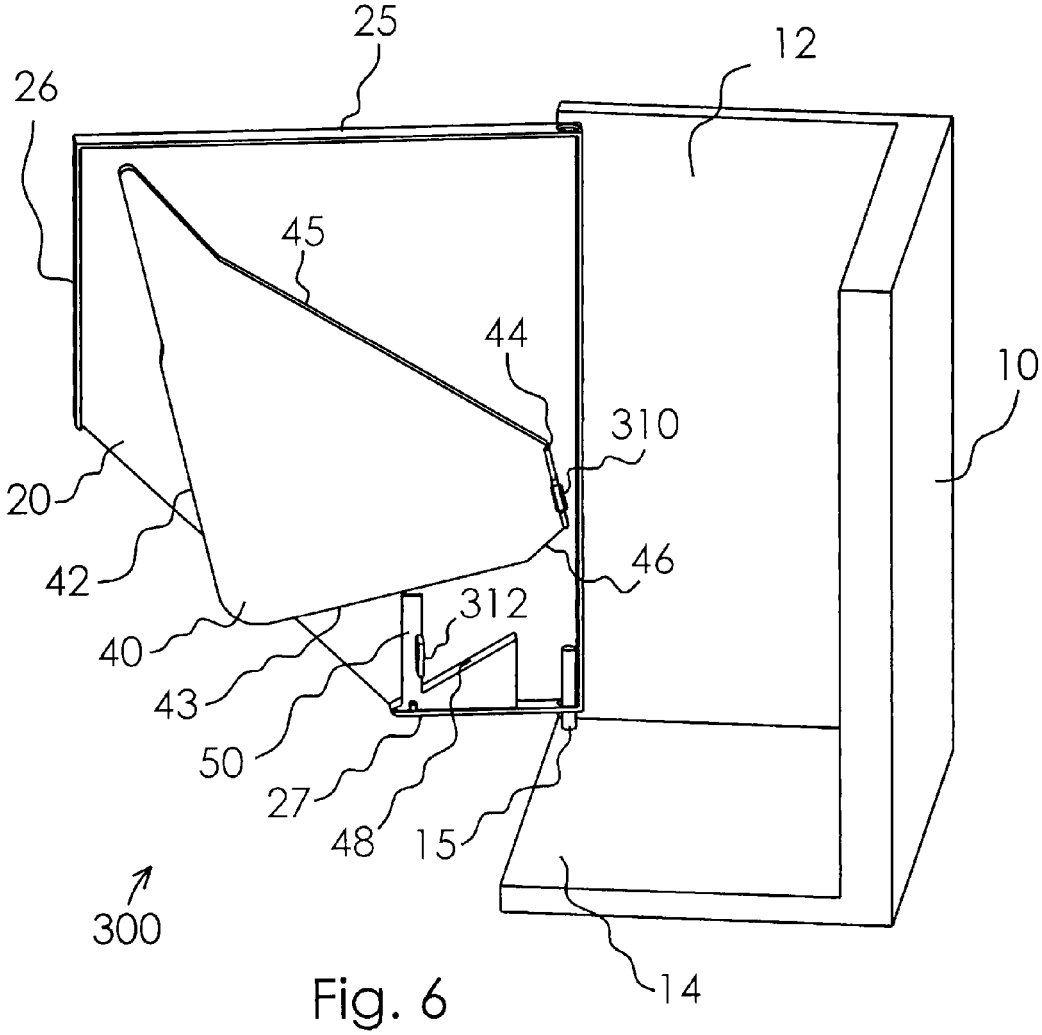
FIG. 6 is a partially broken away side perspective view of a third embodiment of a cabinet door with a retractable panel in a retracted position.

Referring now to FIG. 6, a third embodiment of a cabinet door with a retractable panel is generally identified by the reference numeral 300. The cabinet 300 is substantially similar to the cabinet 100 described above with the exception that the cabinet 300 includes a magnet 310 secured to the stop member 52 and ferrous material 312 secured to the guide 50. The magnet 310 and ferrous material 312 cooperate to maintain the door panel 40 in the closed position.

While preferred embodiments of a cabinet door retractable panel have been shown and described, other and further embodiments thereof may be devised without departing from the basic scope thereof, and the scope thereof is determined by the claims which follow.

The invention claimed is:

1. A cabinet door comprising:

a) a substantially planar first panel, said first panel including a generally vertical first edge, a generally horizontal second edge, a generally vertical third edge, a generally horizontal fourth edge and a fifth edge extending angularly from a lower end of said vertical first edge to a forward end of said horizontal fourth edge;

b) a ramp secured to said first panel proximate said horizontal fourth edge; and c) a moveable substantially planar second panel constrained to move in a parallel plane relative to said first panel, wherein said second panel is capable of translational movement relative to said first panel, wherein said second panel includes a generally horizontal bottom edge, a distal portion of said bottom edge defining an angularly extending surface slideably engaging said ramp.

2. The cabinet door of claim 1 including a flange orthogonal to said first panel defining a partial perimeter about said first panel, and further including a gap in said perimeter along said fifth edge of said first panel.

3. The cabinet door of claim 1 wherein said second panel further includes a front vertical edge, a rear vertical edge and an angular edge extending from an upper end of said rear vertical edge to an upper end of said front vertical edge.

4. The cabinet door of claim 1 including a guide member fixedly secured to said first panel, wherein said guide member is spaced from and extends substantially parallel to said first panel.

5. The cabinet door of claim 4 including a stop member secured proximate a rear vertical edge of said second panel, said stop member selectively engaging said guide member to limit the downward movement of said second panel relative to said first panel.

6. The cabinet door of claim 1 including biasing means for maintaining said second panel in a closed position.

7. The cabinet door of claim 6 wherein said biasing means comprises a spring under tension having a first distal end secured to said second panel and a second distal end secured to said first panel.

8. The cabinet door of claim 1 including a magnet and ferrous material operatively associated to retain said second panel in a closed position.

9. The cabinet door of claim 8 wherein the magnet is secured to said stop member and the ferrous material is secured to said guide member.

10. A cabinet comprising:

a) a top wall, a bottom wall, a rear wall and sidewalls defining an enclosure having an open front side;

b) a door hingedly coupled to a sidewall moveable between an open position and a closed position covering the open front side of said cabinet, said door comprising a substantially planar first panel, said first panel including a generally vertical first edge, a generally horizontal second edge, a generally vertical third edge, a generally horizontal fourth edge and a fifth edge extending angularly from a lower end of said vertical first edge to a forward end of said horizontal fourth edge;

c) a ramp secured to said first panel proximate said horizontal fourth edge; and d) a moveable substantially planar second panel constrained to move in a parallel plane relative to said first panel, wherein said second panel is capable of translational movement relative to said first panel, wherein said second panel includes a generally vertical front edge, a generally horizontal bottom edge, a generally vertical rear edge and an angular edge extending from an upper end of said rear edge to an upper end of said front edge, and wherein a distal portion of said bottom edge defines an angularly extending surface slideably engaging said ramp.

11. The cabinet of claim 10 including a flange orthogonal to said first panel defining a partial perimeter about said first panel, and further including a gap in said perimeter along said fifth edge of said first panel.

12. The cabinet of claim 10 including a guide member fixedly secured to said first panel, wherein said guide member is spaced from and substantially parallel to said first panel.

13. The cabinet of claim 12 including a stop member selectively engaging said guide member to limit the movement of said second panel relative to said first panel.

14. The cabinet of claim 10 including biasing means for maintaining said second panel in a first position relative to said first panel.

* * * * *